US008235057B2

(12) United States Patent
Li et al.

(10) Patent No.: US 8,235,057 B2
(45) Date of Patent: Aug. 7, 2012

(54) SMOKING ARTICLE WITH OPEN ENDED FILTER AND RESTRICTOR

(75) Inventors: San Li, Midlothian, VA (US); Michael S. Braunshteyn, Richmond, VA (US); Raquel M. Olegario, Chesterfield, VA (US); Richard Jupe, Richmond, VA (US); Martin Garthaffner, Chesterfield, VA (US)

(73) Assignee: Philip Morris USA Inc., Richmond, VA (US)

( * ) Notice: Subject to any disclaimer, the term of this patent is extended or adjusted under 35 U.S.C. 154(b) by 849 days.

(21) Appl. No.: 12/073,656

(22) Filed: Mar. 7, 2008

(65) Prior Publication Data

US 2008/0216853 A1 Sep. 11, 2008

Related U.S. Application Data

(60) Provisional application No. 60/906,118, filed on Mar. 9, 2007.

(51) Int. Cl.
*A24D 3/04* (2006.01)

(52) U.S. Cl. ..... 131/339; 131/338; 131/341; 131/344

(58) Field of Classification Search ..... 131/339, 131/338, 341, 344
See application file for complete search history.

(56) References Cited

U.S. PATENT DOCUMENTS

| | | | | |
|---|---|---|---|---|
| 2,511,898 | A | 6/1950 | Brothers | |
| 2,547,119 | A | 4/1951 | Henderson | |
| 2,592,553 | A | 4/1952 | Frankenburg et al. | |
| 2,592,554 | A | 4/1952 | Frankenburg | |
| 2,598,680 | A | 6/1952 | Frankenburg | |
| 2,764,513 | A | 9/1956 | Brothers | |
| 2,769,734 | A | 11/1956 | Bandel | |
| 2,954,772 | A | 10/1960 | Lebert | |
| 2,954,778 | A | 10/1960 | Lebert | |
| 2,954,783 | A | 10/1960 | Lebert | |
| 2,954,786 | A | 10/1960 | Lebert | |
| 3,098,492 | A | 7/1963 | Wurzburg et al. | |
| 3,234,949 | A | 2/1966 | White et al. | |
| 3,236,244 | A | 2/1966 | Irby, Jr. et al. | |
| 3,255,760 | A | 6/1966 | Selke | |
| 3,283,762 | A | 11/1966 | Kissel | |
| 3,292,635 | A | 12/1966 | Kolodny | |
| 3,318,312 | A | 5/1967 | Curtis, Jr. | |
| 3,323,525 | A | 6/1967 | Miller | |
| 3,356,094 | A | 12/1967 | Ellis et al. | |
| 3,389,705 | A * | 6/1968 | Levavi | 131/339 |
| 3,395,713 | A | 8/1968 | Ent-Keller | |
| 3,441,028 | A | 4/1969 | Wall | |
| 3,457,927 | A | 7/1969 | Siragusa | |
| 3,496,945 | A | 2/1970 | Tomkin | |
| 3,504,677 | A | 4/1970 | Doppelt | |
| 3,581,748 | A | 6/1971 | Cameron | |
| 3,599,646 | A | 8/1971 | Berger et al. | |
| 3,630,210 | A | 12/1971 | Haslam | |
| 3,637,447 | A | 1/1972 | Berger et al. | |
| 3,646,941 | A | 3/1972 | Doppelt | |
| 3,648,712 | A | 3/1972 | Patterson | |
| 3,685,522 | A | 8/1972 | Kleinhans | |
| 3,738,375 | A | 6/1973 | Doumas | |
| 3,756,249 | A | 9/1973 | Selke et al. | |
| 3,759,270 | A | 9/1973 | Wright | |
| 3,860,011 | A | 1/1975 | Norman | |
| 3,877,470 | A | 4/1975 | Jewett et al. | |
| 3,931,824 | A | 1/1976 | Miano et al. | |
| 3,968,804 | A | 7/1976 | Kelly et al. | |
| 3,986,515 | A | 10/1976 | Egri | |
| 4,016,887 | A | 4/1977 | Uroshevich | |
| 4,022,222 | A | 5/1977 | Berger | |
| 4,038,994 | A | 8/1977 | Aikman | |
| 4,091,821 | A | 5/1978 | Scorzo | |
| 4,119,105 | A | 10/1978 | Owens, Jr. | |
| 4,120,310 | A | 10/1978 | Lee et al. | |
| 4,135,523 | A | 1/1979 | Luke et al. | |
| 4,158,364 | A | 6/1979 | Ligeti | |
| 4,182,349 | A | 1/1980 | Selke | |
| 4,186,756 | A | 2/1980 | Takemoto et al. | |
| 4,197,863 | A | 4/1980 | Clayton et al. | |
| 4,256,122 | A | 3/1981 | Johnson | |
| 4,256,126 | A | 3/1981 | Seligman et al. | |
| 4,273,141 | A | 6/1981 | Van Tilburg | |

(Continued)

FOREIGN PATENT DOCUMENTS

| | | | |
|---|---|---|---|
| BE | 679657 | A | 10/1966 |

(Continued)

OTHER PUBLICATIONS

International Search Report and Written Opinion mailed Jan. 27, 2009 for PCT/IB2008/001348.

(Continued)

*Primary Examiner* — Richard Crispino
*Assistant Examiner* — Dionne Walls Mayes
(74) *Attorney, Agent, or Firm* — Buchanan Ingersoll & Rooney PC

(57) ABSTRACT

A smoking article includes a tobacco rod adapted to produce mainstream smoke, and a filter having an upstream end and a downstream end, wherein the filter is arranged to receive mainstream smoke at the upstream end. The filter includes a tubular segment open at the downstream end thereof and a flow restrictor contained within the tubular segment. The filter is attached to the tobacco rod with tipping paper and includes an air-admissible ventilating zone at a location between the upstream end and the downstream end of the filter.

14 Claims, 3 Drawing Sheets

U.S. PATENT DOCUMENTS

| | | | | | |
|---|---|---|---|---|---|
| 4,292,983 | A | | 10/1981 | Mensik | |
| 4,340,072 | A | | 7/1982 | Bolt et al. | |
| 4,341,228 | A | | 7/1982 | Keritsis et al. | |
| 4,343,319 | A | | 8/1982 | Cantrell | |
| 4,357,950 | A | | 11/1982 | Berger | |
| 4,380,241 | A | * | 4/1983 | Horsewell | 131/336 |
| 4,386,618 | A | * | 6/1983 | Cantrell | 131/336 |
| 4,421,126 | A | | 12/1983 | Gellatly | |
| 4,460,001 | A | | 7/1984 | Browne et al. | |
| 4,469,112 | A | | 9/1984 | Browne et al. | |
| 4,506,683 | A | | 3/1985 | Cantrell et al. | |
| 4,508,525 | A | | 4/1985 | Berger | |
| 4,515,170 | A | | 5/1985 | Cantrell et al. | |
| 4,542,755 | A | | 9/1985 | Selke et al. | |
| 4,559,955 | A | | 12/1985 | Brockway et al. | |
| 4,564,030 | A | | 1/1986 | Jessup et al. | |
| 4,574,820 | A | | 3/1986 | Pinkerton et al. | |
| 4,585,015 | A | * | 4/1986 | Silberstein | 131/339 |
| 4,617,946 | A | | 10/1986 | Keith | |
| 4,620,553 | A | | 11/1986 | Bale et al. | |
| 4,622,982 | A | | 11/1986 | Gaisch et al. | |
| 4,637,409 | A | | 1/1987 | Berger | |
| 4,646,762 | A | | 3/1987 | Riehl et al. | |
| 4,649,944 | A | | 3/1987 | Houck, Jr. et al. | |
| 4,660,579 | A | | 4/1987 | Horsewell et al. | |
| 4,677,992 | A | | 7/1987 | Bliznak | |
| 4,687,008 | A | | 8/1987 | Houck, Jr. et al. | |
| 4,700,726 | A | | 10/1987 | Townsend et al. | |
| 4,702,263 | A | | 10/1987 | Strydom | |
| 4,732,168 | A | | 3/1988 | Resce et al. | |
| 4,754,766 | A | | 7/1988 | Luke et al. | |
| 4,784,632 | A | | 11/1988 | Berger | |
| 4,791,943 | A | | 12/1988 | Kupper et al. | |
| 4,793,365 | A | | 12/1988 | Sensabaugh et al. | |
| 4,867,182 | A | | 9/1989 | Roberts et al. | |
| 4,896,682 | A | | 1/1990 | Liew | |
| 4,924,886 | A | | 5/1990 | Litzinger | |
| 4,942,887 | A | | 7/1990 | Abdelgawad et al. | |
| 4,949,736 | A | | 8/1990 | Roberts et al. | |
| 4,962,774 | A | | 10/1990 | Thomasson et al. | |
| 4,972,853 | A | | 11/1990 | Brackmann et al. | |
| 4,972,854 | A | | 11/1990 | Kiernan et al. | |
| 4,984,588 | A | | 1/1991 | Stewart, Jr. | |
| 5,046,514 | A | | 9/1991 | Bolt | |
| 5,050,621 | A | | 9/1991 | Creighton et al. | |
| 5,058,608 | A | | 10/1991 | Henning et al. | |
| 5,060,676 | A | | 10/1991 | Hearn et al. | |
| 5,074,319 | A | | 12/1991 | White et al. | |
| 5,099,864 | A | | 3/1992 | Young et al. | |
| 5,101,839 | A | | 4/1992 | Jakob et al. | |
| 5,105,836 | A | | 4/1992 | Gentry et al. | |
| 5,105,838 | A | | 4/1992 | White et al. | |
| 5,129,408 | A | | 7/1992 | Jakob et al. | |
| 5,152,304 | A | | 10/1992 | Bokelman et al. | |
| 5,178,166 | A | | 1/1993 | Newsome et al. | |
| 5,190,061 | A | | 3/1993 | Brackmann et al. | |
| 5,203,354 | A | | 4/1993 | Hickle | |
| 5,360,023 | A | | 11/1994 | Blakley et al. | |
| 5,392,792 | A | | 2/1995 | Banerjee et al. | |
| 5,392,793 | A | * | 2/1995 | Molloy | 131/339 |
| 5,435,326 | A | | 7/1995 | Gentry et al. | |
| 5,458,107 | A | | 10/1995 | Balogh et al. | |
| 5,524,647 | A | | 6/1996 | Brackmann | |
| 5,533,530 | A | | 7/1996 | Young et al. | |
| 5,568,819 | A | | 10/1996 | Gentry et al. | |
| 5,584,306 | A | | 12/1996 | Beauman et al. | |
| 5,598,868 | A | | 2/1997 | Jakob et al. | |
| 5,666,976 | A | | 9/1997 | Adams et al. | |
| 5,690,127 | A | | 11/1997 | Chapman et al. | |
| 5,709,227 | A | | 1/1998 | Arzonico et al. | |
| 5,715,844 | A | | 2/1998 | Young et al. | |
| 5,724,998 | A | | 3/1998 | Gellatly et al. | |
| 5,727,571 | A | | 3/1998 | Meiring et al. | |
| 5,743,251 | A | | 4/1998 | Howell et al. | |
| 5,746,230 | A | | 5/1998 | Arterbery et al. | |
| 5,839,449 | A | | 11/1998 | Banerjee et al. | |
| 5,954,061 | A | | 9/1999 | Cardarelli | |
| 5,979,459 | A | | 11/1999 | Schneider | |
| 6,062,228 | A | * | 5/2000 | Loercks et al. | 131/332 |
| 6,089,238 | A | | 7/2000 | Schneider et al. | |
| 6,216,706 | B1 | | 4/2001 | Kumar et al. | |
| 6,257,242 | B1 | | 7/2001 | Stavridis | |
| 6,345,625 | B1 | | 2/2002 | Chew | |
| 6,502,580 | B1 | | 1/2003 | Luparini | |
| 6,718,989 | B1 | | 4/2004 | Clarke et al. | |
| 6,761,174 | B2 | | 7/2004 | Jupe et al. | |
| 6,779,529 | B2 | | 8/2004 | Figlar et al. | |
| 6,814,786 | B1 | | 11/2004 | Zhuang et al. | |
| 6,823,873 | B2 | | 11/2004 | Nichols et al. | |
| 6,883,516 | B2 | | 4/2005 | Hindle et al. | |
| 6,883,523 | B2 | | 4/2005 | Dante | |
| 2002/0166561 | A1 | | 11/2002 | Sinclair, Jr. | |
| 2003/0200973 | A1 | | 10/2003 | Xue et al. | |
| 2003/0200976 | A1 | | 10/2003 | Yoo | |
| 2004/0025890 | A1 | | 2/2004 | Yen | |
| 2004/0159327 | A1 | | 8/2004 | Dante | |
| 2004/0261807 | A1 | | 12/2004 | Dube et al. | |
| 2005/0066981 | A1 | | 3/2005 | Crooks et al. | |
| 2006/0201524 | A1 | | 9/2006 | Zhang et al. | |
| 2007/0169785 | A1 | | 7/2007 | Gedevanishvili et al. | |
| 2007/0181140 | A1 | | 8/2007 | Xue et al. | |
| 2007/0186945 | A1 | | 8/2007 | Olegario et al. | |
| 2007/0235050 | A1 | | 10/2007 | Li et al. | |
| 2007/0261706 | A1 | | 11/2007 | Banerjea et al. | |
| 2008/0017204 | A1 | | 1/2008 | Braunshteyn et al. | |
| 2008/0035162 | A1 | | 2/2008 | Braunshteyn et al. | |
| 2008/0047571 | A1 | | 2/2008 | Braunshteyn et al. | |
| 2008/0163877 | A1 | | 7/2008 | Zhuang et al. | |
| 2008/0216848 | A1 | | 9/2008 | Li et al. | |
| 2008/0216850 | A1 | | 9/2008 | Li et al. | |
| 2008/0216851 | A1 | | 9/2008 | Olegario et al. | |
| 2010/0288293 | A1 | | 11/2010 | Slasli et al. | |

FOREIGN PATENT DOCUMENTS

| | | | |
|---|---|---|---|
| BE | 1000454 | A4 | 12/1988 |
| DE | 3439861 | A1 | 5/1985 |
| EP | 0 054 705 | A1 | 6/1982 |
| EP | 0077123 | A2 | 4/1983 |
| EP | 0101840 | A | 3/1984 |
| EP | 0212879 | A1 | 3/1987 |
| EP | 0 327 655 | A1 | 8/1989 |
| EP | 0364256 | A1 | 4/1990 |
| EP | 0471581 | A1 | 2/1992 |
| EP | 0482872 | A1 | 4/1992 |
| EP | 0568107 | A | 11/1993 |
| EP | 0481596 | B1 | 1/1994 |
| FR | 2481581 | | 11/1981 |
| FR | 2873899 | A | 2/2006 |
| GB | 1058342 | A | 2/1967 |
| GB | 1228747 | | 4/1971 |
| GB | 1236344 | A | 6/1971 |
| GB | 1245518 | A | 9/1971 |
| GB | 1256154 | | 12/1971 |
| GB | 1428018 | | 3/1976 |
| GB | 2100573 | A | 1/1983 |
| GB | 2149287 | A | 6/1985 |
| GB | 2177890 | A | 2/1987 |
| NZ | 19697 | | 11/1983 |
| NZ | 216244 | | 9/1989 |
| WO | WO 90/09741 | A | 9/1990 |
| WO | WO 99/26495 | A | 6/1999 |
| WO | WO 00/00047 | | 1/2000 |
| WO | WO 01/13745 | A1 | 3/2001 |
| WO | WO 02/03819 | A | 1/2002 |
| WO | WO 2006/070289 | A | 7/2006 |
| WO | WO 2006/082529 | A | 8/2006 |
| WO | WO 2007/093757 | A1 | 8/2007 |
| WO | WO2007/110650 | A1 | 10/2007 |

OTHER PUBLICATIONS

International Preliminary Report on Patentability issued Sep. 15, 2009 for PCT/IB2008/001348.

Written Opinion dated Aug. 5, 2004 for International Application No. PCT/US04/04530.

International Search Report dated Aug. 5, 2004 for PCT/US04/04530.

International Search Report dated Oct. 19, 2007 for International Application No. PCT/IB2006/004202.
Written Opinion dated Oct. 19, 2007 for International Application No. PCT/IB2006/004202.
Invitation to Pay Additional Fees and Annex to Form PCT/ISA/206 Communication Relating to the Results of the Partial International Search dated Oct. 16, 2007 for International Application No. PCT/IB2006/004209.
International Search Report and Written Opinion dated Mar. 17, 2008 for PCT/IB2006/004209.
International Preliminary Report on Patentability dated Jul. 10, 2008 for PCT/IB2006/004202.
International Preliminary Report on Patentability dated Jul. 10, 2008 for PCT/IB2006/004209.
International Search Report and Written Opinion dated Sep. 19, 2008 for PCT/IB2007/004503.
International Preliminary Report on Patentability mailed Jul. 9, 2009 for PCT/IB2007/004503.
International Preliminary Report on Patentability mailed Sep. 24, 2009 for International Application No. PCT/IB2008/001372.
International Search Report and Written Opinion dated Nov. 3, 2008 for PCT/IB2008/001372.
International Preliminary Report on Patentability for PCT/IB2007/004224 dated May 19, 2009.
International Preliminary Report on Patentability for PCT/GB2007/001144 dated Sep. 30, 2008.
International Search Report and Written Opinion for PCT/IB2007/004224 dated Jun. 13, 2008.
International Search Report and Written Opinion for PCT/GB2007/00114 dated Jul. 11, 2007.
International Preliminary Report on Patentability mailed Sep. 15, 2009 for PCT/IB2008/001383.
International Search Report and Written Opinion mailed Feb. 24, 2009 for PCT/IB2008/001383.
Partial International Search Report mailed Nov. 11, 2008 for PCT/IB2008/001383.
International Preliminary Report on Patentability issued Jan. 13, 2009 for PCT/IB2007/002869.
International Search Report and Written Opinion dated Jan. 25, 2008 for PCT/IB2007/002869.
International Preliminary Report on Patentability issued Jan. 13, 2009 for PCT/IB2007/002910.
International Search Report and Written Opinion dated Jan. 24, 2008 for PCT/IB2007/002910.
New Zealand Examination Report cited in New Zealand Patent Application No. 573730, Jul. 8, 2010.
International Search Report and Written Opinion dated Oct. 7, 2008 for PCT/IB2008/001382.
International Preliminary Report on Patentability issued Sep. 15, 2009 for PCT/IB2008/001382.
International Preliminary Report on Patentability issued Feb. 10, 2009 for PCT/IB2007/003165.
New Zealand Examination Report cited in New Zealand Patent Application No. 571453, Mar. 10, 2010.
International Search Report and Written Opinion dated Mar. 26, 2008 for PCT/IB2007/003165.
U.S. Appl. No. 12/576,922, filed Oct. 9, 2009.
U.S. Appl. No. 12/782,443, filed May 18, 2010.
International Search Report mailed Sep. 13, 2010 for International Application No. PCT/EP2010/003016.

* cited by examiner

SMOKING ARTICLE WITH OPEN ENDED FILTER AND RESTRICTOR

CROSS-REFERENCE TO RELATED APPLICATION

This application claims priority to U.S. Patent Provisional Application No. 60/906,118, filed Mar. 9, 2007, which is incorporated herein by this reference in its entirety.

BACKGROUND

Heretofore, cigarettes with high levels of ventilation have usually had unacceptably low levels of resistance to draw (RTD) unless some counter measure was in place to make-up the shortfall in RTD. In the past, high density cellulose acetate filter segments were used to address the short fall. However such filtered segments tended to reduce tar delivery (FTC), with little or no effect upon gas phase components of mainstream tobacco smoke, such as carbon monoxide (CO) and nitrogen oxide (NO). This solution tended to worsen the CO to tar (FTC) ratios in lower delivery (FTC tar) cigarettes.

Ventilation has a desirable attribute in that, when operating alone, it will reduce both the particulate phase and the gas phase of mainstream smoke. Highly ventilated cigarettes however have drawbacks in RTD as previously discussed.

DETAILED DESCRIPTION OF PREFERRED EMBODIMENTS

In accordance with one embodiment, a smoking article comprises: a tobacco rod adapted to produce mainstream smoke; a filter having an upstream end and a downstream end, the filter arranged to receive mainstream smoke at the upstream end, the filter comprising: a tubular segment open at the downstream end thereof; and a flow restrictor contained within the tubular segment; and tipping paper attaching the filter with the tobacco rod and including an air-admissible ventilating zone at a location between the upstream end and the downstream end of the filter.

In accordance with another embodiment, a smoking article comprising a tobacco rod and a filter, the filter comprises: a paper filter tube open at a downstream end thereof and attached to the tobacco rod with tipping paper; a flow restrictor contained within the filter tube, the flow restrictor dividing the filter tube into an upstream cavity and a downstream cavity; and a ventilation zone at a location along the downstream cavity, the ventilation zone comprising a plurality of perforations extending through the tipping paper and the filter tube.

In accordance with a further embodiment, a smoking article comprises: a tobacco rod adapted to produce mainstream smoke; a filter having an upstream end and a downstream end, the filter arranged to receive mainstream smoke at the upstream end, the filter comprising: a paper tubular segment open at a downstream end thereof; and a flow restrictor contained within the tubular segment, the flow restrictor comprising a paper foam rod having at least one channel, wherein the at least one channel is introduced into an outer periphery of the paper foam rod; and tipping paper attaching the filter with the tobacco rod and including an air-admissible ventilating zone at a location between the upstream end and the downstream end of the filter.

Figure 1:
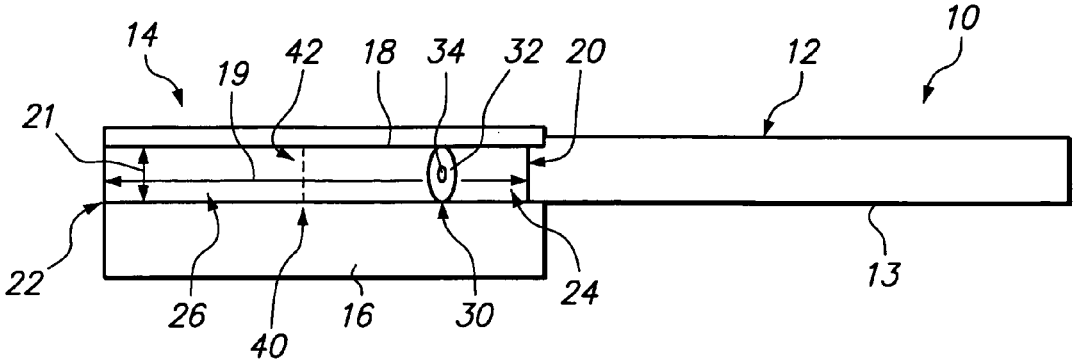
FIG. 1 is a side view of the smoking article constructed in accordance with a preferred embodiment, wherein the filter tipping paper has been partially unfolded to reveal internal filter components.

FIG. 1 shows a side view of a smoking article 10 constructed in accordance with a preferred embodiment, wherein the filter tipping paper 16 has been partially unfolded to reveal internal filter components. As shown in FIG. 1, a preferred embodiment provides a smoking article 10 comprising a tobacco rod 12 and a filter (or filter assembly) 14 connected with the tobacco rod 12 by a tipping paper 16. The tobacco rod 12 is preferably comprised of a cylindrical rod of smoking material, such as shredded tobacco (usually, in cut filler form) surrounded in a circumscribing outer wrapper 13. The outer wrapper 13 is typically a porous wrapping material or paper wrapper.

The filter 14 preferably includes a tubular segment (or filter tube) 18 having an upstream end 20, a downstream end or mouth end 22, and a flow restrictor 30 situated within the tubular segment 18. The flow restrictor 30 preferably comprises a partition 32 having at least one orifice (or flow restriction) 34 of reduced diameter. The flow restrictor 30 divides the tubular segment 18 into an upstream segment or cavity 24, and a downstream segment or cavity 26 open at the downstream end 22 thereof. The filter 14 can also include a porous paper plug (not shown) on the downstream or mouth end 22 of the filter 14 for appearance. It can be appreciated that the porous paper plug preferably does not extend to the flow restrictor 30 in order to maintain a downstream segment or cavity 26 within the filter 14.

The tubular segment 18 is preferably made of a paper product or a biodegradable plastic or other suitable material having degradability properties. The tubular segment 18 preferably has a length 19 of approximately 20.0 to 40.0 mm and more preferably about 25.0 to 35.0 mm and most preferably approximately 27.5 to 31 mm with an inner diameter 21 of approximately 7.0 to 8.0 mm and more preferably approximately 7.4 to 7.8 mm.

Different ventilation levels (10-90%) can be incorporated into the tubular segment 18, through combinations of the flow restrictor 30, a ventilating zone 40 (or ventilation zone), the permeability of the tipping paper 16, and the permeability of the paper or material used for the tubular segment 18, to provide a desired smoke delivery (FTC tar) from the same cigarette. In accordance with one embodiment, the tubular segment 18 is preferably constructed from a rigid paper that forms a self-supporting tubular segment that can be perforated by suitable laser equipment or other device to add at least one circumferential row or series of ventilation holes 42 to the tubular segment 18.

In accordance with another embodiment, an air-admissible ventilating zone 40 (or ventilating zone) can be established with a first row (and optionally a second and possibly third rows) of ventilation holes 42 extending through the tipping paper 16 and the tubular segment 18. In the preferred embodiment, the air-admissible ventilating zone 40 is located near or adjacent to the flow restrictor 30 so that air drawn through the ventilation zone 40 is allowed to mix with the mainstream smoke before arriving at the downstream end or mouth end 22 of the filter 14. In accordance with one embodiment, the ventilation holes 42 are preferably downstream of the flow restrictor 30, such that the ventilation holes 42 are between the flow restrictor 30 and the downstream or mouth end 22. The distance between the ventilating zone 40 (or ventilation holes 42) and the downstream or mouth end 22 of the filter 14 is preferably at least 5 mm and more preferably in the range of 5-20 mm, and most preferably in the range of 10-15 mm. However, it can be appreciated that in accordance with another embodiment the ventilation holes 42 can be upstream of the flow restrictor 30, such that the ventilation holes 42 are between the tobacco rod 12 and the flow restrictor 30.

In accordance with another embodiment, the flow restrictor 30 and the ventilation zone 40 preferably achieve a ventilation level of the smoking article 10 of at least 25% and more preferably at least 50% to 90%. The ventilation level of the smoking article 10 also preferably introduces a resistance to draw (RTD) to the smoker that is at an acceptable level. The resistance to draw (RTD) can also be adjusted by changing the number and the size of the orifices 34 of the flow restrictor 30, as well as the position of the ventilation zones 40 on the filter 14. In accordance with another embodiment, the wrapping paper 13 can have high permeability or alternatively perforations can be used to achieve high tobacco rod ventilation.

Furthermore, the embodiments provide the necessary amount of resistance to draw (RTD) while maintaining the desired degree of high ventilation throughout the smoke. The latter attribute is achieved by placement of the ventilating zone 40 downstream of the restrictor 30. Furthermore, placing the ventilating zone 40 in a spaced apart relation to the downstream end or mouth end 22 assures mixing of air drawn into the filter 14 through the ventilating zone 40 with mainstream smoke drawn from the tobacco rod 12.

Figure 2:
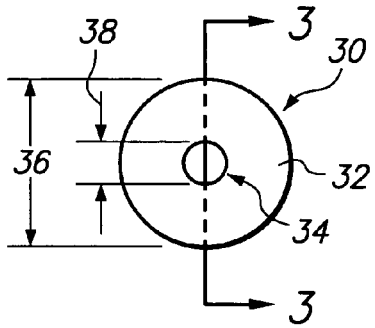
FIG. 2 is a cross sectional view of a flow restrictor in accordance with one embodiment.

FIG. 2 shows a cross-sectional view of a flow restrictor 30 in accordance with one embodiment. As shown in FIG. 2, the flow restrictor 30 preferably comprises a partition 32 having at least one orifice (or flow restriction) 34 of reduced diameter. The flow restrictor 30 is preferably sized to contribute sufficient pressure drop such that the smoking article 10 presents a resistance to draw (RTD) of at least 40 mm water or greater, preferably in the range of 50-80 mm water.

Preferably, the partition 32 has a diameter 36 of approximately 7.0 to 8.0 mm and more preferably approximately 7.4 to 7.8 mm. The partition 32 also preferably has one or optionally, at least one orifice 34 of a diameter 38 of about 0.2 mm to about 0.9 mm. The flow restrictor 30 may be constructed of paper, a plastic or a metal and more preferably made of a paper product, a biodegradable plastic, or other suitable material having degradability properties.

Figure 3:
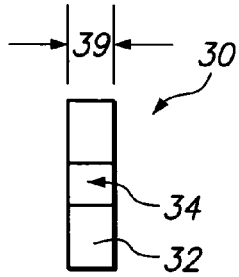
FIG. 3 is a side, cross sectional view of the flow restrictor of FIG. 2 along line 3-3.

FIG. 3 shows a side, cross sectional view of the flow restrictor 30 of FIG. 2 along the line 3-3. As shown in FIG. 3, the flow restrictor 30 can be a partition 32 having at least one orifice 34. The partition 32 has a width 39, which can vary from about 0.05 mm to 20.0 mm, and more preferably about 0.5 to 2.0 mm.

Figure 4:
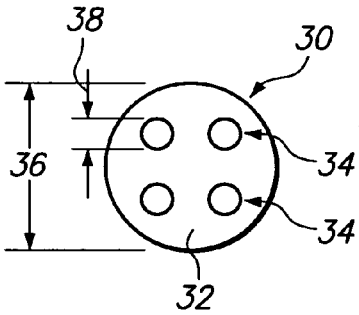
FIG. 4 is a cross sectional view of a flow restrictor in accordance with another embodiment.

FIG. 4 shows a cross sectional view of a flow restrictor 30 in accordance with another embodiment. As shown in FIG. 4, since the pressure drop of the flow restrictor 30 depends on the open area, multiple orifices 34 can also be used. For example, in accordance with a further embodiment, at least two or more orifices 34 of at least 0.2 mm diameter 38 each can be incorporated into the partition 32. It can be appreciated that the number, the size and the placement or location of the orifices 34 within the partition 32 can vary, such that a desired pressure drop within the filter 14 can be established in combination with the ventilating zone 40.

Figure 5:
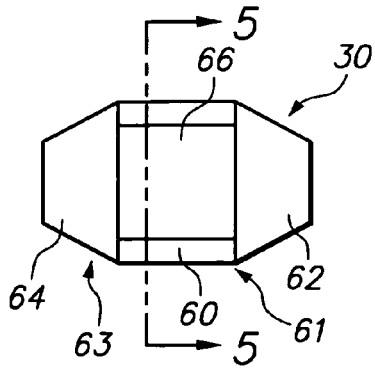
FIG. 5 is a side, cross sectional view of another alternate embodiment for a flow restrictor.

FIG. 5 shows a side, cross-sectional view of a flow restrictor 30 in accordance with another embodiment. As shown in FIG. 5, the flow restrictor 30 comprises at least two flow channels 60, each channel 60 having a pair of conical ends 62, 64. The flows channels 60 include a downstream end 61 and an upstream end 63, which are open to allow flow or smoke to flow through. The flow channels 60 are preferably introduced into an outer periphery 67 (FIG. 6) of a paper foam rod 66, which forms the middle portion of the flow restrictor 30. It can be appreciated that the flow restrictor 30 comprises at least two flow channels 60 and can include three or more flow channels 60, which are preferably symmetrically positioned around the outer periphery 67 of the paper foam rod 66. Other materials such as plastics or rubbers can also be used. The paper foam rod 66 can have an oval, round, hexagonal or other suitable cross-section. The pair of conical ends 62, 64 are preferably opposite one another (i.e., the smaller portion of the conical end facing outward from the middle portion) to facilitate insertion of the flow restrictor 30 into the tubular segment 18. The flow restrictor 30 is also preferably symmetrical, which prevents tobacco filler from blocking the smoke flow channels 60, and benefits the cigarette manufacture process and the restrictor's 30 functionality.

Figure 6:
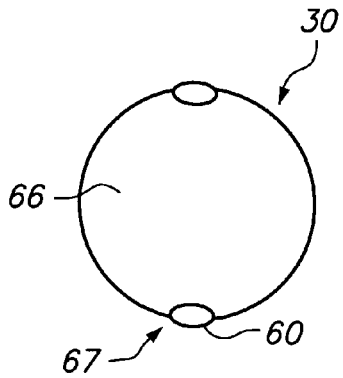
FIG. 6 is a cross sectional view of the flow restrictor of FIG. 5 along line 5-5 in accordance with one embodiment.

FIG. 6 shows a cross sectional view of the flow restrictor 30 of FIG. 5 along line 5-5 in accordance with one embodiment. As shown in FIG. 6, the flow restrictor 30 includes at least two flow channels 60, which are positioned symmetrically around the outer periphery 67 of the paper foam rod 66. The at least two channels 60 can have an oval or circular cross-section or other suitable cross-sectional shapes and/or configurations.

Figure 7:
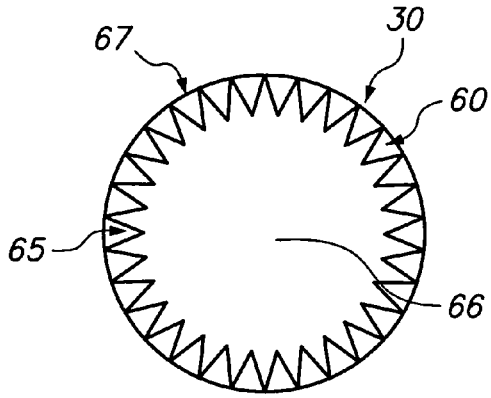
FIG. 7 is a cross sectional view of a flow restrictor of in accordance with another embodiment.

FIG. 7 shows a cross sectional view of the flow restrictor 30 in accordance with another embodiment. As shown in FIG. 7, the flow restrictor 30 includes a plurality of channels 60 around the outer periphery 67 of the paper foam rod 66, in the form of a plurality of grooves 65 having a V-shaped cross section. It can be appreciated that the grooves 65 can be V-shaped, rectangular, oval, or other suitable configurations.

Figure 8:
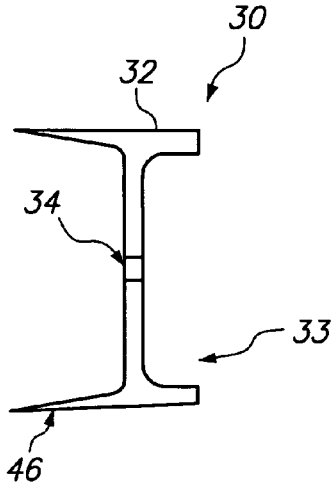
FIG. 8 is a side, cross sectional view of a further embodiment for a flow restrictor.

FIG. 8 shows a side, cross sectional view of a further embodiment for a flow restrictor 30. The flow restrictor 30 comprises a partition (traverse wall) 32 having at least one orifice 34 and an outer annulus 46 extending around the outer periphery 33 of the partition 32. As shown in FIG. 8, the outer annulus 46 may be slightly conical to facilitate insertion of the flow restrictor 30 into the tubular segment 18.

Figure 9:
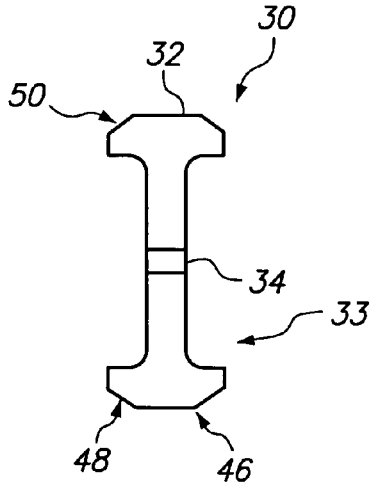
FIG. 9 is a side, cross sectional view of another alternate embodiment for a flow restrictor.

FIG. 9 shows a side, cross sectional view of another alternate embodiment for a flow restrictor 30. The flow restrictor 30 comprises a partition 32 having at least one orifice 34 and an outer annulus 46 extending around the outer periphery 33 of the partition 32. As shown in FIG. 9, the outer annulus 46 can include a symmetrical footing 48 having chamfered or beveled edges 50 to facilitate insertion of the flow restrictor 30 into the tubular segment 18.

In accordance with another embodiment, a screening material (not shown) can be used to prevent loose tobacco fillers blocking the orifices 34 (or channels 60). The total cigarette or smoking article's 10 resistance to draw (RTD) as well as tar delivery is balanced with combinations of ventilating zones 40, the diameter 38 of the orifices 34 (or channels 60), and the number of orifices 34 (or channels 60). It can be appreciated that with an increased level of ventilation, the air flowing into the smoking article's burning coal will be reduced, which will reduce the amount of tobacco burned, the coal temperature, and smoke component generation. In addition, enhanced diffusion out of the cigarette paper (i.e., outer wrapper 13) resulting from the slower flow rate can further reduce the gaseous smoke components such as carbon monoxide (CO) and nitrogen oxide (NO).

Figure 10:
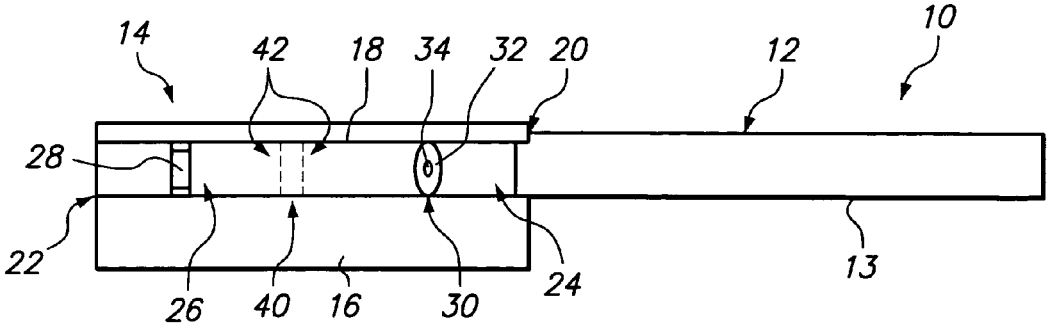
FIG. 10 is a side view of the smoking article constructed in accordance with another embodiment, wherein the filter tipping paper has been partially unfolded to reveal internal filter components.

FIG. 10 shows a side view of the smoking article 10 constructed in accordance with another embodiment, wherein the filter tipping paper 16 has been partially unfolded to reveal internal filter components. As shown in FIG. 10, it may be desirable to provide several ventilating zones 40 at locations in relation to the orifices 34 provided in the flow restrictor 30 to achieve the more elevated ventilation levels. The ventilating zone 40 preferably comprises a plurality of ventilation holes 42, which extends through the tipping paper 16 and the tubular segment 18. It can be appreciated that the filter 14 facilitates the use of online laser perforation techniques in the manufacture of the smoking article 10. It can be appreciated that in accordance with another embodiment, the manufacturing of the smoking article 10 can be facilitated with the use of pre-perforated tipping paper 16.

It is to be appreciated that in all embodiments, the filter 14 may be constructed from simple combining techniques typically used in the industry for manufacturing cigarettes at high speeds. Additionally, each embodiment can include at least one support 28 (FIG. 10) about the upstream and/or downstream cavities 24, 26 so as to provide desired firmness throughout length of the filter 14. The support 28 preferably is an annular ring on an inner and/or outer surface of the tubular segment 18 or other suitable device, which can provide rigidity to the tubular segment 18 of the filter 14.

Figure 11:
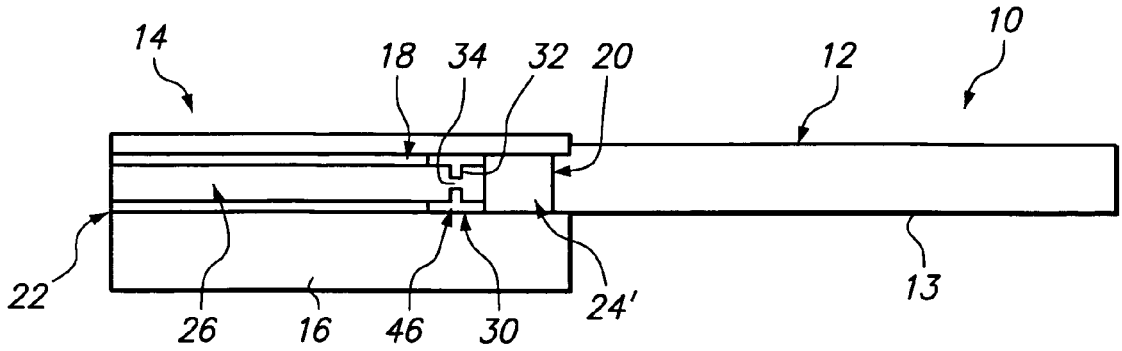
FIG. 11 is a side view of the smoking article constructed in accordance with another embodiment, wherein the filter tipping paper has been partially unfolded to reveal internal filter components.

FIG. 11 illustrates an embodiment similar in some respects to that shown in FIG. 1 but wherein the tubular element 18 is a soft porous tubular material such as a tube of cellulose acetate commonly referred to as a hollow acetate tube or HAT. The use of the HAT provides a softer feel to the lips of the smoker than the feel of a filter constructed with a rigid paper tube such as those of other embodiments described herein. The flow restrictor 30 can take the form of the flow restrictors described herein but preferably is of the type shown in FIG. 9 wherein a partition 32 extends inwardly from outer annulus 46 and one or more orifices 34 extend through the partition. An upstream plug 24' of filter material separates the flow restrictor 30 from the tobacco rod 12. The tube 18, restrictor 30 and plug 24' can be wrapped in paper such as conventional plug wrap. This arrangement allows the filter to be assembled using high speed combining machinery and obviates the need to plunge filter components into a rigid tube. Further, pre-perforated tipping paper can be used thus obviating the need to form perforations through the rigid tube in the earlier embodiments.

It can be appreciated that with a smoking article 10 as shown in FIGS. 1-10, wherein the filter is free of filtering material such as cellulose acetate plugs, the cost associated with cellulose acetate material and manufacturing can be eliminated. In addition, the smoking article's environmental impact of cigarette butt littering is also reduced.

The embodiments as shown and described herein provide the benefit of a highly ventilated smoking article with desired amounts of resistance to draw and provisions for facilitating high-speed cigarette manufacturing on conventional cigarette making equipment.

It will be understood that the foregoing description is of the preferred embodiments, and is, therefore, merely representative of the article and methods of manufacturing the same. It can be appreciated that variations and modifications of the different embodiments in light of the above teachings will be readily apparent to those skilled in the art. Accordingly, the exemplary embodiments, as well as alternative embodiments, may be made without departing from the spirit and scope of the articles and methods as set forth in the attached claims.

What is claimed is:

1. A smoking article comprising a tobacco rod and a filter, the filter comprising:

a paper filter tube open at a downstream end thereof and attached to the tobacco rod with tipping paper;

a flow restrictor contained within the filter tube, the flow restrictor dividing the filter tube into an upstream cavity and a downstream cavity; and a ventilation zone at a location along the downstream cavity, the ventilation zone comprising a plurality of perforations extending through the tipping paper and the filter tube, wherein the flow restrictor comprises a paper foam rod having at least two channels.

2. The smoking article of claim 1, wherein the ventilation zone is between the upstream end of the filter and the flow restrictor.

3. The smoking article of claim 1, wherein the ventilation zone is between the flow restrictor and the downstream end of the filter.

4. The smoking article of claim 1, wherein the at least two channels are introduced into an outer periphery of the paper foam rod.

5. A smoking article comprising:

a tobacco rod adapted to produce mainstream smoke;

a filter having an upstream end and a downstream end, the filter arranged to receive mainstream smoke at the upstream end, the filter comprising:

a tubular segment open at the downstream end thereof; and a flow restrictor contained within the tubular segment, the flow restrictor comprising a paper foam rod having at least one channel, wherein the at least one channel is introduced into an outer periphery of the paper foam rod; and tipping paper attaching the filter with the tobacco rod and including an air-admissible ventilating zone at a location between the upstream end and the downstream end of the filter.

6. A smoking article comprising:

a tobacco rod adapted to produce mainstream smoke;

a filter having an upstream end and a downstream end, the filter arranged to receive mainstream smoke at the upstream end, the filter comprising:

a tubular segment open at the downstream end thereof;

a flow restrictor comprising a paper foam rod upstream of the tubular segment;

a plug of filter material upstream of the flow restrictor;

tipping paper attaching the filter with the tobacco rod and including an air-admissible ventilating zone at a location between the upstream end and the downstream end of the filter, wherein the tubular segment is a hollow tube of cellulose acetate.

7. The smoking article of claim 6, wherein the air-admissible ventilating zone comprises at least one circumferential row of ventilation holes extending through the tipping paper.

8. The smoking article of claim 6, wherein the air-admissible ventilating zone is between the upstream end of the filter and the flow restrictor.

9. The smoking article of claim 6, wherein the air-admissible ventilating zone is between the flow restrictor and the downstream end of the filter.

10. The smoking article of claim 6, wherein the ventilating zone is spaced from the downstream end of the filter by a distance sufficient to promote mixing of air drawn through the air-admissible ventilating zone and mainstream smoke drawn from the tobacco rod.

11. The smoking article of claim 6, wherein the flow restrictor is a partition having at least one orifice.

12. The smoking article of claim 11, wherein the partition has a plurality of orifices, and wherein each of the plurality of orifices has a diameter of about 0.2 mm to 0.6 mm.

13. The smoking article of claim 11, wherein the partition has an outer annulus extending around an outer periphery of the partition to facilitate insertion of the flow restrictor into the tubular segment.

14. The smoking article of claim 6, wherein the flow restrictor has at least two channels, which are introduced into an outer periphery of the paper foam rod.

* * * * *